US008038273B2

(12) United States Patent
Frasure et al.

(10) Patent No.: US 8,038,273 B2
(45) Date of Patent: Oct. 18, 2011

(54) INK TANK VENTING

(75) Inventors: Tim Frasure, Nicholasville, KY (US); Girish Shivaji Patil, Lexington, KY (US); George Allan Ping, Berea, KY (US); Jon Brock Whitney, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 1187 days.

(21) Appl. No.: 11/691,701

(22) Filed: Mar. 27, 2007

(65) Prior Publication Data

US 2008/0239031 A1 Oct. 2, 2008

(51) Int. Cl.
*B41J 2/175* (2006.01)

(52) U.S. Cl. ..... 347/86

(58) Field of Classification Search ..... 347/85, 347/86

See application file for complete search history.

(56) References Cited

U.S. PATENT DOCUMENTS 6,332,676 B1 * 12/2001 Santhanam ..... 347/86

* cited by examiner

*Primary Examiner* — Geoffrey Mruk

(57) ABSTRACT

An inkjet cartridge having an ink container including a venting structure with an orifice through a wall of the ink container in direct communication with a meniscus baffle extending into the interior of the ink container. An inkjet cartridge lid including serpentine trenches and orifices formed within a top surface. At least one of the serpentine trenches intersects with at least one of the orifices. The venting structure includes a corridor interposing at least two separate ink reservoirs and including opposing first and second ends. The first end of the corridor resides in communication with an external environment while the second end is partitioned to establish a separate passage in communication with each of the at least two separate ink reservoirs, each passage including a hollow extending into an interior of the ink reservoir.

11 Claims, 10 Drawing Sheets

INK TANK VENTING

FIELD OF THE INVENTION

The present invention is directed to venting structures and, more specifically, to venting structures incorporated into ink tanks to equate the pressure between the interior of the ink tank and an external environment. The instant invention also includes processes for fabricating venting structures and processes to facilitate venting of ink tanks.

INTRODUCTION TO THE INVENTION

It is a first aspect of the present invention to provide an inkjet cartridge comprising an ink container including a venting structure comprising an orifice through a wall of the ink container in direct communication with a meniscus baffle extending into the interior of the ink container.

In a more detailed embodiment of the first aspect, the meniscus baffle and the wall of the orifice cooperate to define a plurality of holes feeding into the orifice, where at least one of the plurality of holes transitions into an open trough vertically inclined within the interior of the ink tank. In yet another more detailed embodiment, open trough is at least partially defined by a vertically inclined projection and at least two ledges longitudinally extending along the projection, and at least one of the two ledges includes a non-circular cross-section. In a further detailed embodiment, at least one of the two ledges includes a cross-sectional area substantially a frustum of a pyramid, where the cross-sectional area of the frustum decreases along a longitudinal portion of the projection. In still a further detailed embodiment, at least one of the two ledges includes a V-shaped cross-sectional area, where a diameter of the V-shaped cross-sectional area decreases along a longitudinal portion of the projection. In a more detailed embodiment, a proximal end of the meniscus baffle includes a convex distributor inset within the orifice of the ink container. In a more detailed embodiment, the convex distributor includes at least one of a conical shape and a domed shape. In another more detailed embodiment, the invention further comprises a printhead in fluid communication with an interior of the ink container.

It is a second aspect of the present invention to provide an inkjet cartridge lid comprising a lid structure including an external surface defined in part by a serpentine trench that intersects with an conduit extending through the lid structure, the lid structure also comprising a venting structure including a recessed watershed cooperating with an interior wall of the conduit to demarcate a plurality of orifices, at least one of the plurality of orifices in series with a vertically angled gutter of the watershed to establish fluid communication between the gutter and an opening of the conduit at the external surface of the lid structure.

In yet another more detailed embodiment of the second aspect, the vertically angled gutter includes a non-circular cross-section. In still another more detailed embodiment, the gutter is at least partially defined by a vertically inclined projection and at least two ridges longitudinally extending along the projection, and at least one of the two ridges includes a cross-sectional area substantially a frustum of a pyramid, where the cross-sectional area of the frustum decreases along a longitudinal portion of the trough. In a further detailed embodiment, the gutter is at least partially defined by a vertically inclined projection and at least two ridges longitudinally extending along the projection, and at least one of the two ridges includes a V-shaped cross-sectional area, where a diameter of the V-shaped cross-sectional area decreases along a longitudinal portion of the trough. In still a further detailed embodiment, the watershed includes at least one of a conical shape and a domed shape. In a more detailed embodiment, the invention further comprises a printhead in fluid communication with an interior of the ink container.

It is a third aspect of the present invention to provide an inkjet cartridge lid comprising a lid structure including serpentine trenches and orifices formed within a top surface, at least one of the serpentine trenches intersecting with at least one of the orifices, the lid structure also comprising a venting structure that includes a corridor interposing at least two separate ink reservoirs and including opposing first and second ends, the first end of the corridor in communication with an external environment, the second end partitioned to establish a separate passage in communication with each of the at least two separate ink reservoirs, each passage including a hollow extending into an interior of the ink reservoir.

It is a fourth aspect of the present invention to provide a vent for a container comprising a conduit including a recessed, inverted watershed that cooperates with an interior wall of the conduit to demarcate a plurality of orifices, at least one of the plurality of orifices in series with a vertically oriented gutter to establish a fluid communication between the gutter and an opening within the conduit upstream from the watershed, where the opening is in communication with an external gaseous environment.

In yet another more detailed embodiment of the fourth aspect, the gutter is defined by an exposed surface of a distally extending portion of the watershed and an exposed surface of at least two longitudinally extending appendages of the watershed. In still another more detailed embodiment, the gutter inhibits meniscus formation that would otherwise arrest fluid flow along the gutter. In a further detailed embodiment, the watershed includes at least one of a conical shape and a domed shape facing away from the plurality of orifices. In still a further detailed embodiment, each of the plurality of orifices has a cross-sectional area less than ten percent of a cross-sectional area of the conduit approximate the watershed.

It is a fifth aspect of the present invention to provide a vent for a container comprising a plurality of funnels mounted to one another, each funnel tapering toward, and in communication with, a collection conduit, the collection conduit at least partially housing a convex distributor operative to direct upstream fluid flow through the collection conduit and moving downstream past the distributor into the plurality of funnels.

DETAILED DESCRIPTION

The exemplary embodiments of the present invention are described and illustrated below to encompass methods of venting ink containers as well as devices for venting ink containers. Of course, it will be apparent to those of ordinary skill in the art that the preferred embodiments discussed below are exemplary in nature and may be reconfigured without departing from the scope and spirit of the present invention. However, for clarity and precision, the exemplary embodiments as discussed below may include optional steps, methods, and features that one of ordinary skill should recognize as not being a requisite to fall within the scope of the present invention.

Figure 1:
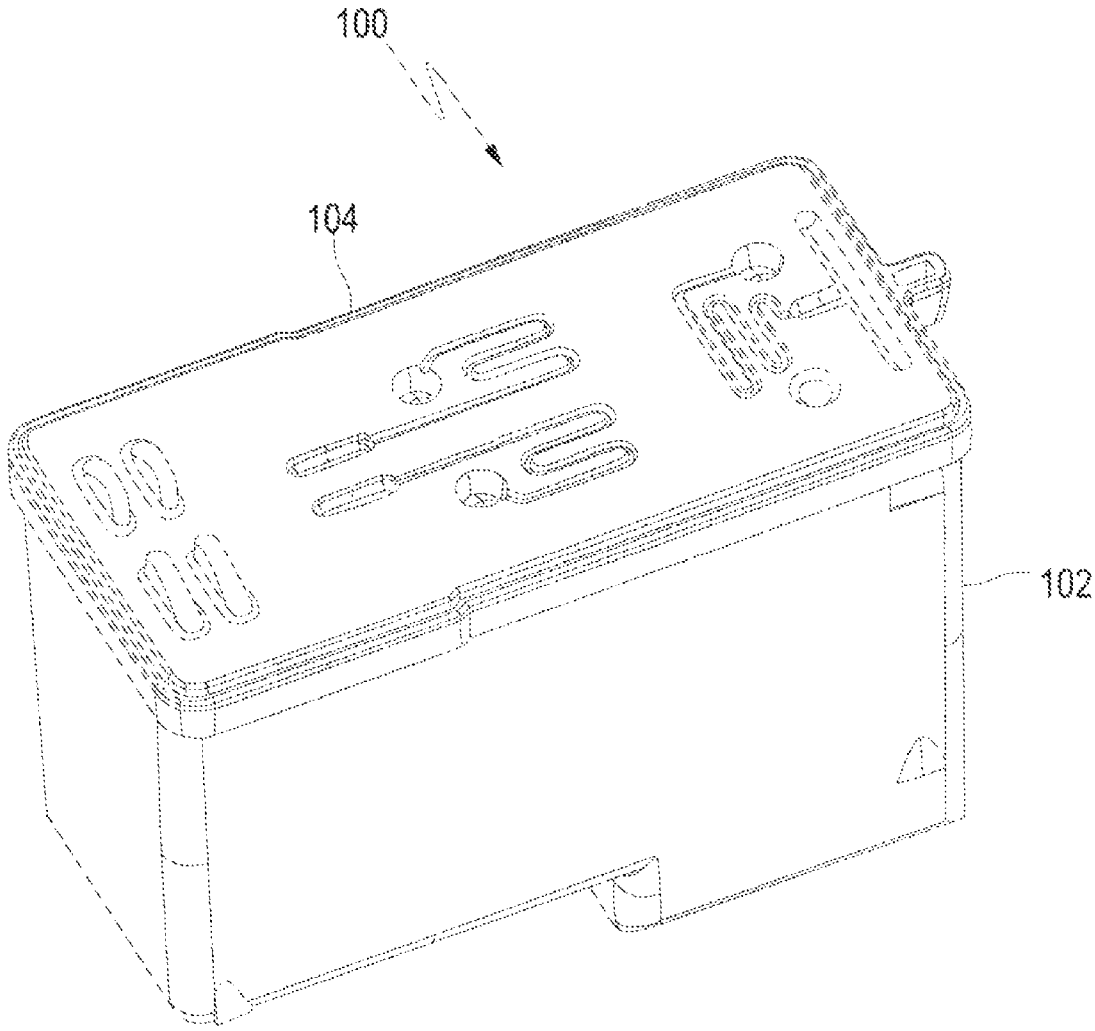
FIG. 1 is an elevated perspective view of an exemplary ink cartridge in accordance with the instant invention.
Figure 2:
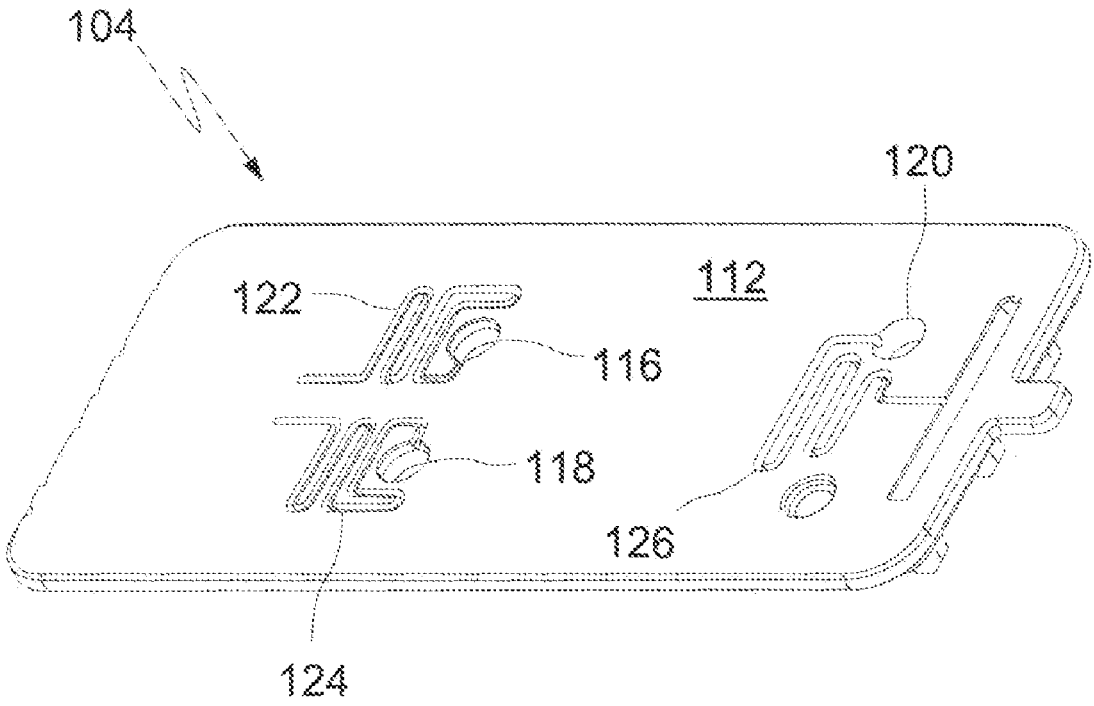
FIG. 2 is an elevated perspective view of an exemplary ink cartridge lid in accordance with the instant invention.

Referencing FIG. 1, a first exemplary embodiment comprises an ink cartridge 100 that includes an ink tank 102, an ink tank lid 104, and an ink tank lid label (not shown). In exemplary form, the ink tank 102 comprises a plurality of ink reservoirs (not shown) that may be filled with the same color or with differing colored inks such as, without limitation, cyan colored ink, magenta colored ink, and yellow colored ink. While the foregoing ink tank 102 may be simply used as a supply vessel for an inkjet printing application, it is also within the scope of the invention that the ink tank 102 include a printhead (not shown) on the underside of the ink tank for on-carrier inkjet applications.

Referencing FIGS. 2-5, the ink tank lid 104 has a generally rectangular profile with rounded corners that transition between a top surface 112 and an opposed bottom surface 114. Three cylindrical openings 116, 118, 120 extend between the top and bottom surfaces 112, 114 to establish fluid communication between an interior of the ink tank 102 and an external environment. Each cylindrical opening 116, 118, 120 is approximately 3 millimeters in diameter. The top surface includes three serpentine trenches 122, 124, 126, with a first end of each trench perpendicularly extending into one of the openings 116, 118, 120, while a second opposed end of each trench is positioned away from the openings. A separate sealed conduit is created between the second end of each trench 122, 124, 126 and each opening 116, 118, 120 by adhering the label to the top surface 112 of the tank lid 104. In exemplary form, the label is adhesively adhered to the top surface 112 after the bottom surface 114 of the ink tank lid 104 has been mounted to the ink tank 102. Those skilled in the art are familiar with typical procedures and techniques for adhering the label to an ink tank and/or ink tank lid.

Figure 3:
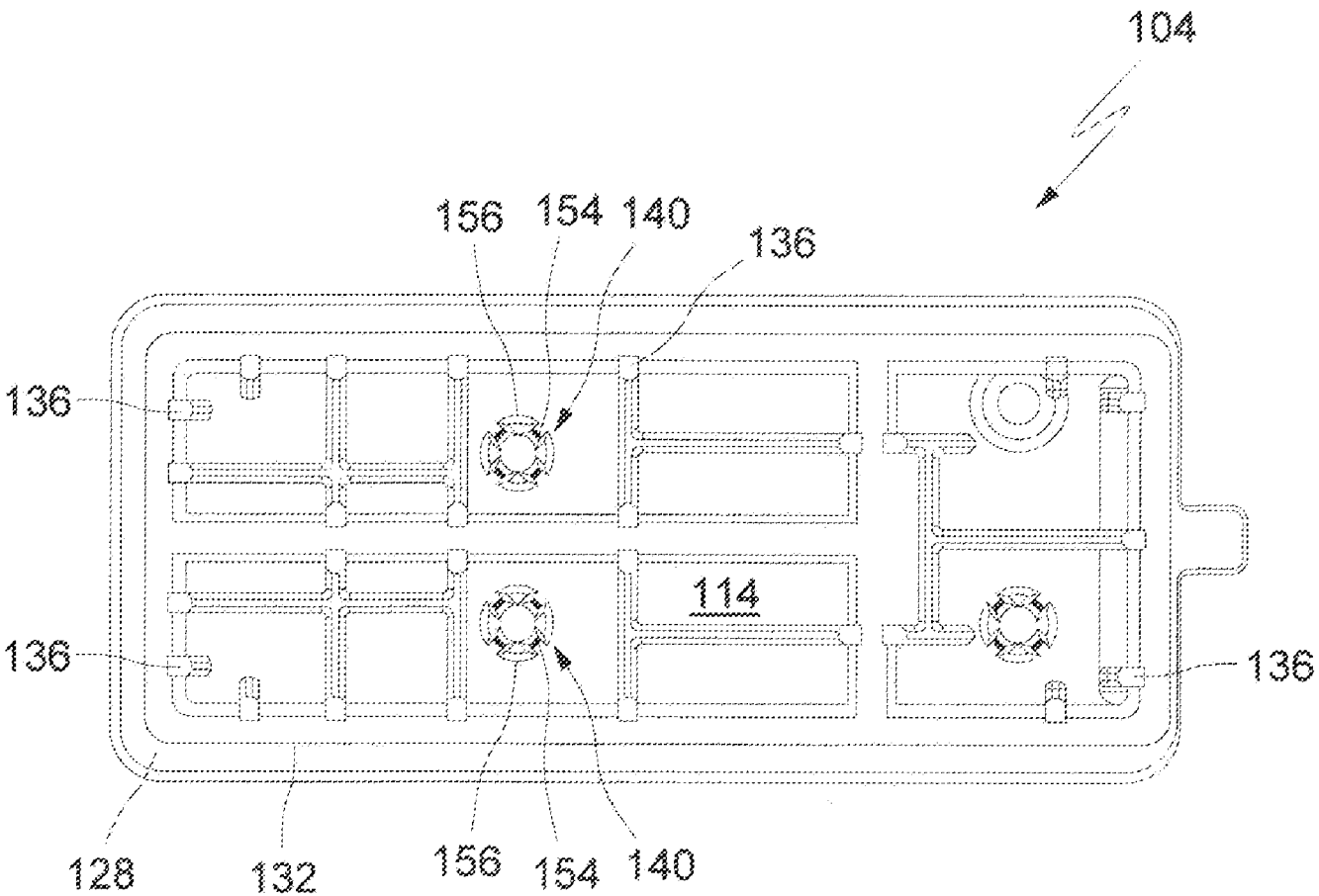
FIG. 3 is a bottom view of the exemplary ink cartridge lid of FIG. 2.
Figure 4:
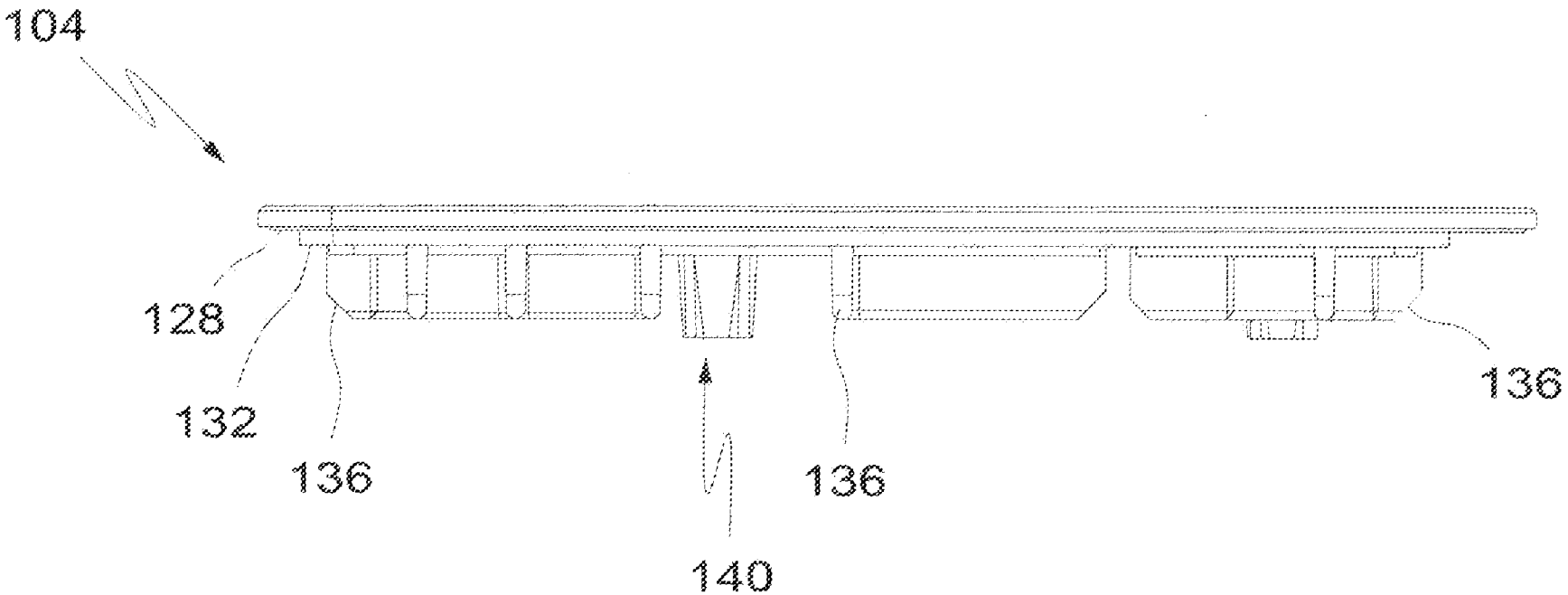
FIG. 4 is a right side profile view of the exemplary ink cartridge lid of FIG. 2.
Figure 5:
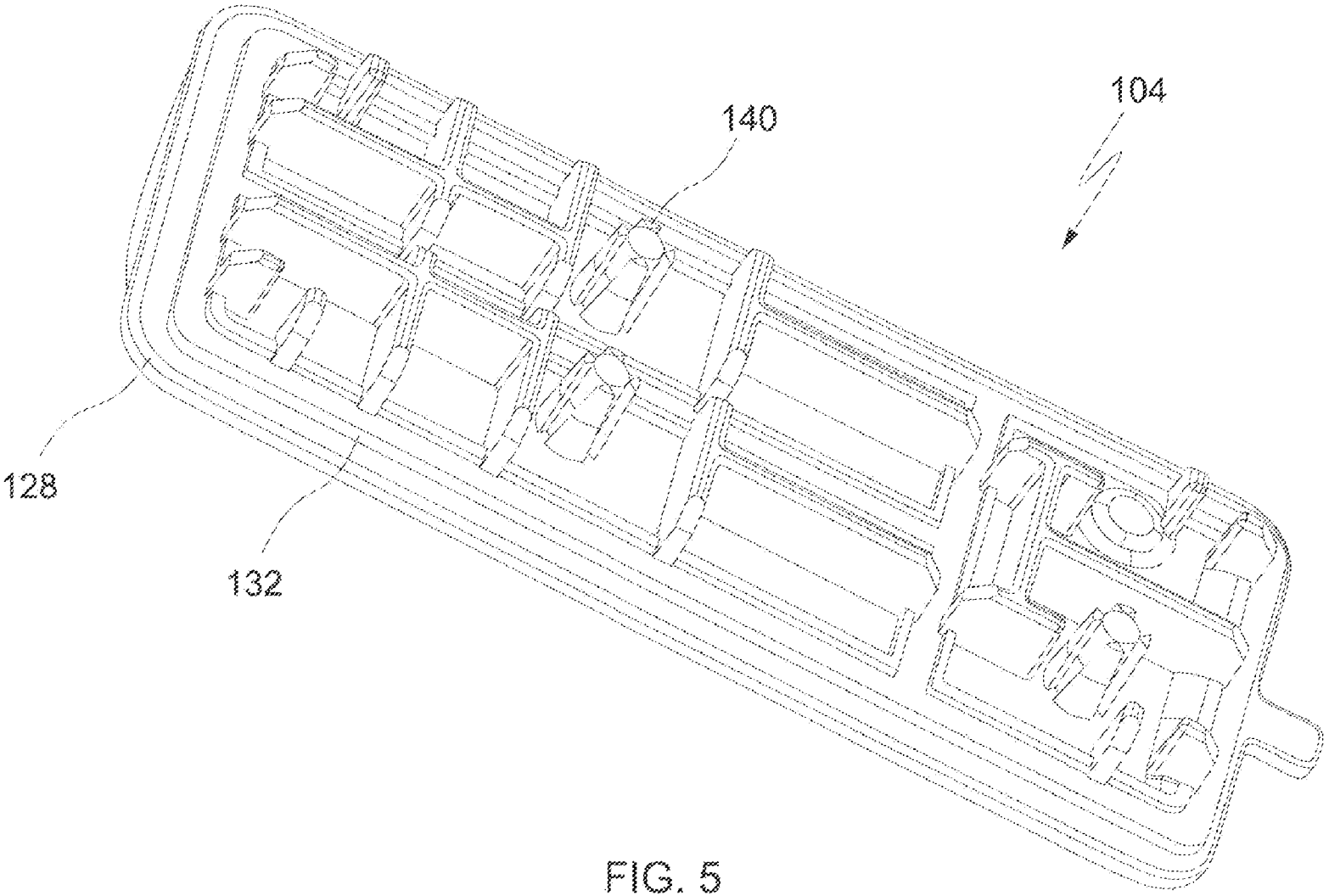
FIG. 5 is an elevated perspective view of the bottom of the exemplary ink cartridge lid of FIG. 2.
Figure 6:
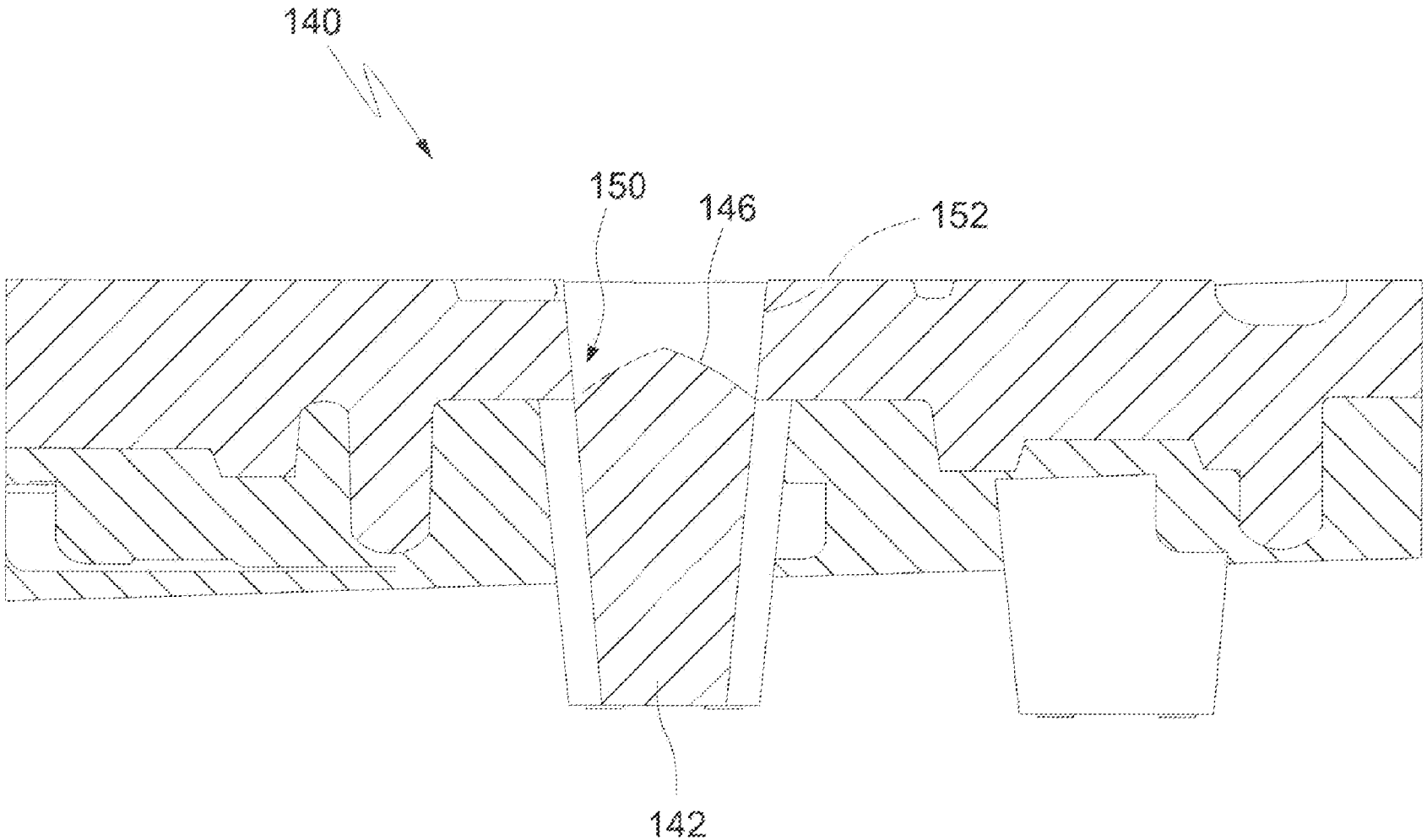
FIG. 6 is a cross-sectional view of the exemplary ink cartridge lid of FIG. 2 taken along line 6-6.
Figure 7:
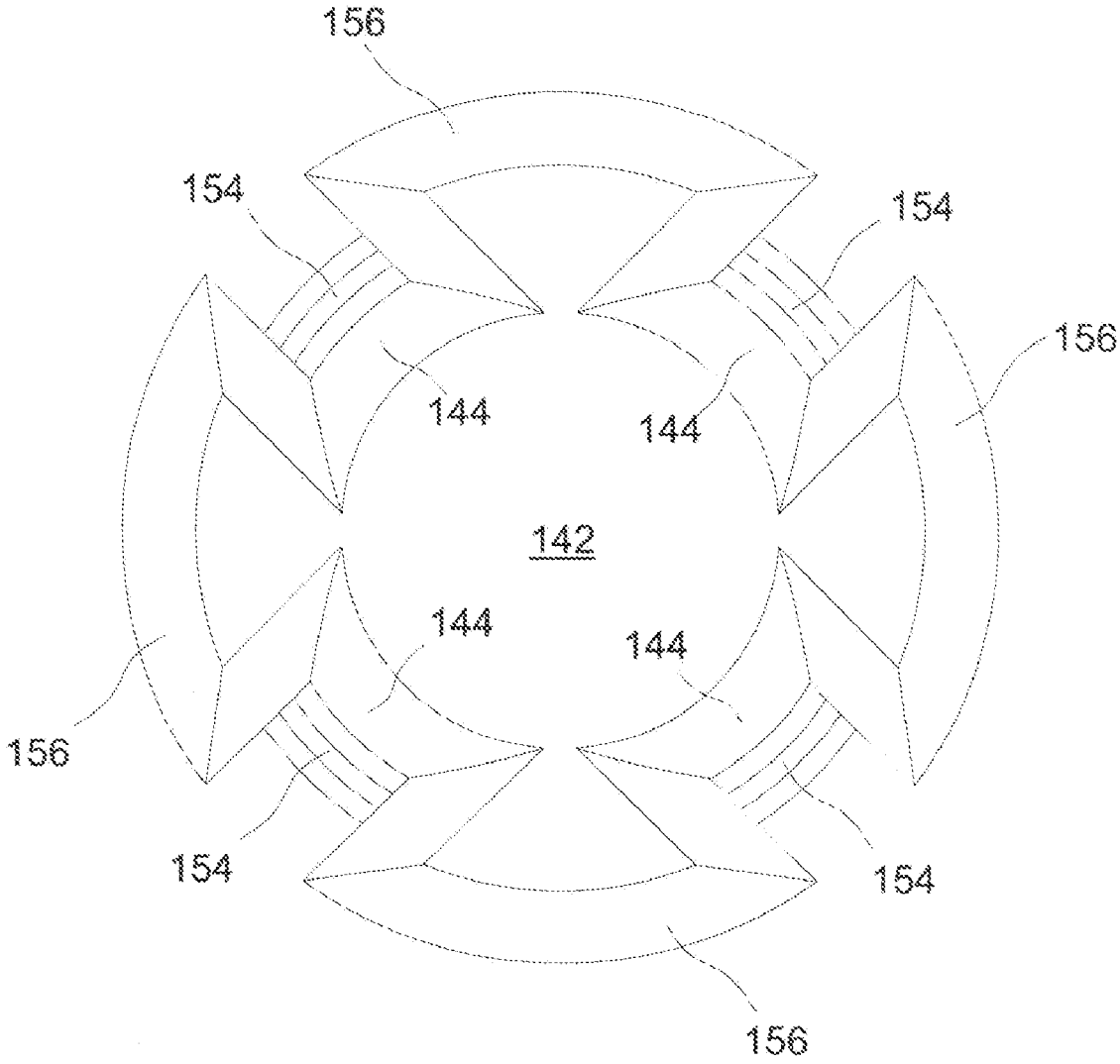
FIG. 7 is a bottom view of an exemplary venting structure in accordance with the present invention.
Figure 8:
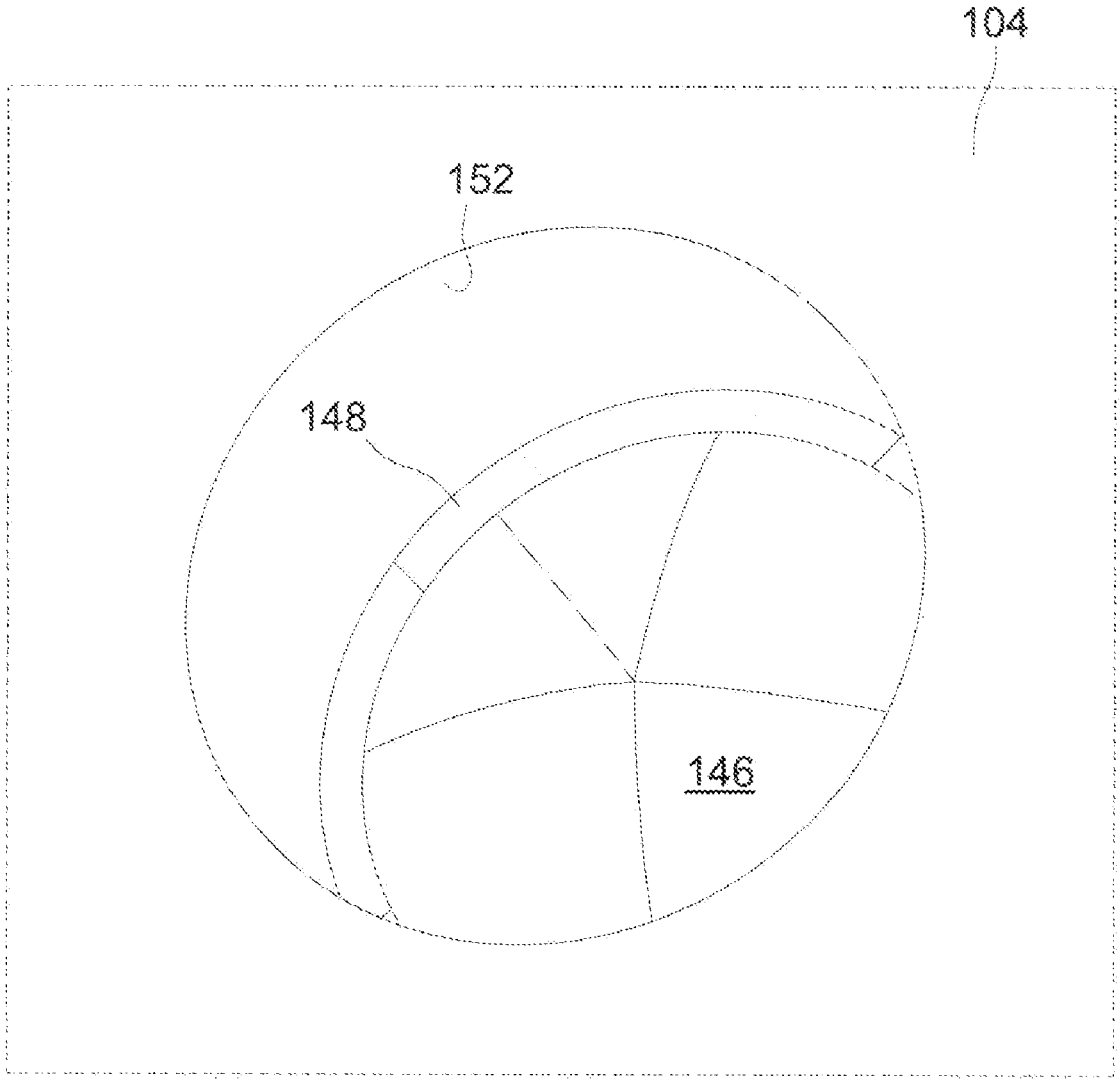
FIG. 8 is an elevated perspective view of the exemplary venting structure of FIG. 7.

Referring to FIG. 3-5, a flanged perimeter 128 of the bottom surface 114 lies on the top perimeter surface 130 of the ink tank 102, while an inset plateau 132 abuts the vertical surface of the ink tank walls 134 to align the lid 104 with respect to the tank 102. A secondary set of alignment projections 136 extend from the bottom surface 114 of the lid 104 and likewise abut the respective interior vertical walls 138 of the eventual reservoirs 106, 108, 110 to ensure proper positioning of the lid 104 with respect to the tank 102. An adhesive (not shown) is applied to at least one of the flanged perimeter 128 and top perimeter surface 130 before the lid 104 and tank 102 are brought into contact with one another to fabricate the plurality of ink reservoirs 106, 108, 110.

Referring to FIG. 2-8, each opening 116, 118, 120 includes a venting structure 140 operative to disrupt fluid menisci from forming and blocking the openings 116, 118, 120 on the bottom surface 114, also referred to as a meniscus baffle. The meniscus baffle is operative because the non-enclosed vertical conduit does not provide a cross-section that is enclosed, thereby negating any meniscus from forming. Each venting structure includes a tapering cylindrical projection 142 having vertically extending and tapering circular walls 144 that transition into a domed top surface 146. The cylindrical projection 142 is mounted to the bottom surface 114 by four bridges 148 so that the domed top surface 144 is inset within the opening. A maximum diameter of the domed top surface 146 (approximately 2.5 millimeters) is less than the diameter of each opening 116, 118, 120, thereby providing a circumferential groove 150 between the circumferential portion of the domed top surface 146 and the interior cylindrical walls 152. The four bridges 148 cooperates with the cylindrical projection 142 and the interior cylindrical walls 152 to define four fluid passages 154 extending to the bottom surface 114 that resemble inverted funnels with a longitudinal opening. Each bridge 148 comprises a ledge 156 having a triangular cross-section that extends longitudinally approximately five millimeters along the exterior wall of the cylindrical projection 142, where the dimensions of the triangular cross-section diminish analogous to the taper of the cylindrical projection 142. The non-arcuate surfaces of the projection inhibit menisci formation that might otherwise operate to inhibit gaseous species from entering or exiting the interior reservoirs via the openings 116, 118, 120. For purposes of the instant disclosure, a meniscus is the curved upper surface of a nonturbulent liquid in a vertical conduit.

Figure 9:
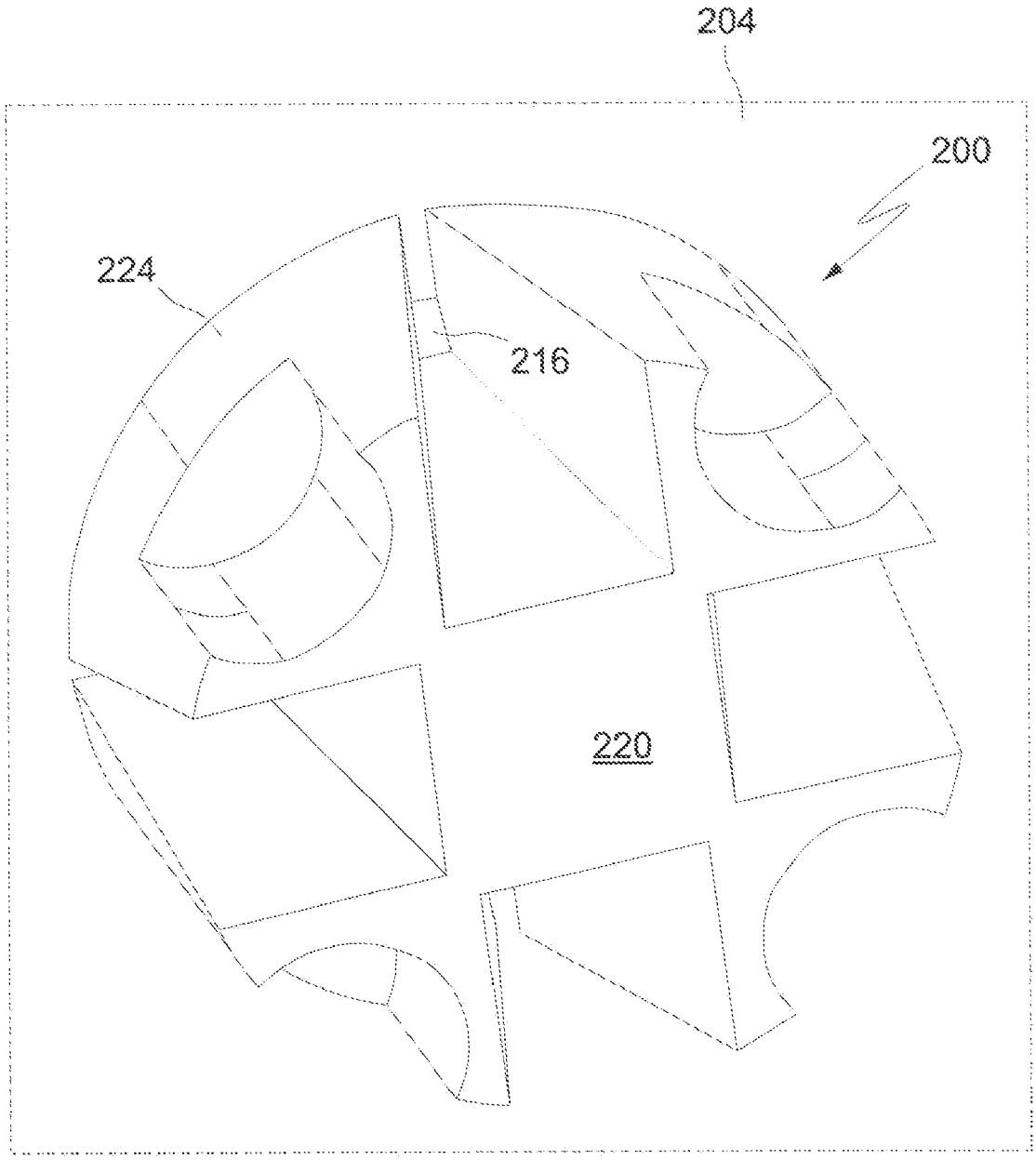
FIG. 9 is a bottom view of a second exemplary venting structure in accordance with the present invention.
Figure 10:
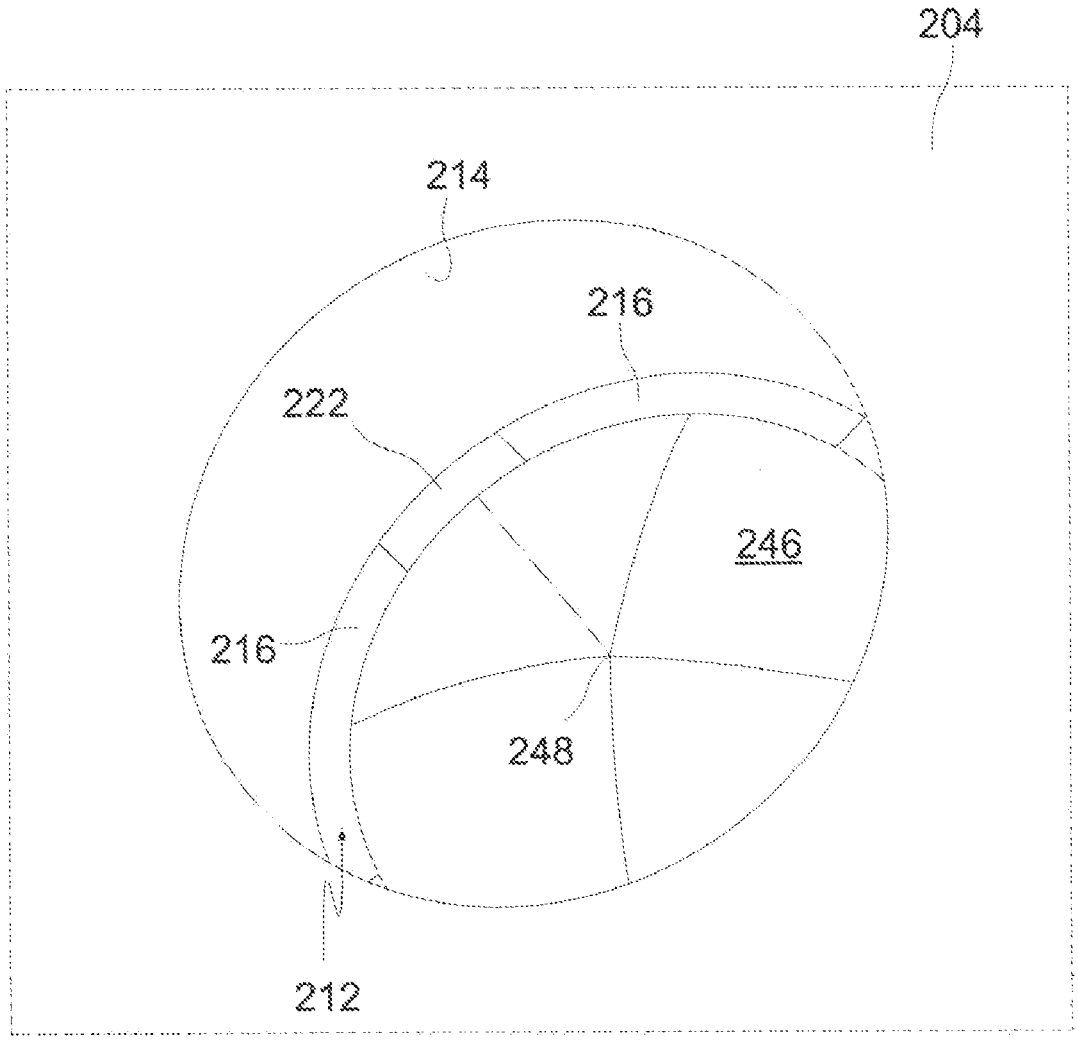
FIG. 10 is an elevated perspective view from the bottom of the second exemplary venting structure of FIG. 9.

Referring to FIGS. 9 and 10, a second exemplary venting structure 200 operative to disrupt fluid menisci from forming an blocking a cylindrical channel (not shown) through an exemplary ink lid 204. In this exemplary venting structure 200, the cylindrical channel is approximately nine millimeters in diameter and includes an inset domed circular protrusion 246 having an apex 248 directed toward the top surface of the lid 204. In this manner, if liquid enters the channel, the domed protrusion 206 acts as a watershed and directs the liquid downward around the protrusion into a tapering circular trough 212 formed between the protrusion and interior walls 214 of the opening. Four orifices 216 at the base of the trough 212 provide fluid communication between the bottom surface and top surface of the lid 204. The domed circular protrusion 246 tapers away from the channel as a rectangular cross-sectioned projection 220. Four bridges 222 are operative to mount the projection 220 to the lid 204, where each bridge 222 comprises a ridge having a triangular cross-section that abruptly transitions into a V-shaped cross-section 224 that extends approximately five millimeters longitudinally along the exterior wall of the projection 220. The dimensions of the triangular cross-section and V-shaped cross-section diminish analogous to the taper of the projection 220. The non-arcuate surfaces of the projection 220 inhibit menisci formation that might otherwise operate to inhibit gaseous species from entering or exiting through the channel 202.

A principal difference between the first venting structure 140 and the second exemplary venting structure 200 is the decrease in material necessary to form the ridge 224 (as opposed to the ledge 150) based upon the V-shaped cross section as opposed to the triangular cross-section of the ledge 150. A second principal difference is the ratio between the diameter of the opening versus the length of the projection. In the first exemplary venting structure 140, this ratio was 0.5, while for the second exemplary venting structure the ratio is 1.8. It is to be understood that the ratio will generally increase with increasing hole or opening diameters though the lid.

Nevertheless, to fall within the scope of the instant invention it is not required to have an increase in ratio with an increase in hole or opening diameter through the lid.

It is also within the scope of the present invention to utilize the exemplary venting structure to concurrently disrupt fluid menisci from forming and blocking a venting channel through an exemplary ink lid for two or more ink reservoirs. In such an exemplary embodiment, a single venting structure is operative to concurrently vent multiple ink reservoirs where the reservoir walls are adjacent to one another, which in exemplary form might include a T-shaped projection that is received by corresponding walls of an ink tank, where the corresponding walls have been formed to receive the T-shaped projection and form three separate ink reservoirs. In such an exemplary embodiment, a single channel is formed through the ink tank lid, having an exemplary diameter of approximately nine millimeters, to overlap the T-shaped projection. An inset domed circular protrusion having an apex is seated within the channel and directed toward the top surface of the lid. The domed circular protrusion includes a T-shaped extension that extends upward within the channel which inhibits fluid mixing between the respective reservoirs. Opposite the apex, the domed circular protrusion and the interior walls of the channel cooperate to define a circumferential tapering groove that is divided into three separate grooves by the T-shaped extension. Each of the three separate grooves leads to a pair of openings allowing fluid communication between the respective reservoirs and an external environment. Each opening comprises a proximal end of a vertical trough bounded by cooperation of the vertical walls of the T-shaped projection and the vertical walls of a bubble inhibitor. In exemplary form, the bubble inhibitor comprises a tapering triangular projection. However, the bubble inhibitor in exemplary form is any structure that inhibits the formation of a meniscus that would block the travel of gaseous species. Generally, bubble inhibitors of the instant invention are include any structure that is or cooperates with another structure to create an open flow path. More specifically, an open flow path includes those structures that are unbounded in cross-section. In other words, the flow path is not tubular (which is bounded circumferentially), but is rather not enclosed longitudinally.

Each of the aforementioned venting structures 140, 200 may be incorporated into an ink tank lid or other structure for venting between an interior of a container and an external environment. Exemplary process for fabricating the exemplary venting structures include injection molding and laser welding. Moreover, the exemplary venting structures can be wholly or partially machined from case or molded parts by eroding the materials to create the features of the venting structures discussed previously. Those skilled in the art reviewing the exemplary discussion and representative drawings will certainly be familiar with techniques to implement this invention and therefore, for purpose of brevity, an exhaustive listing and explanation of fabrication techniques has been omitted.

Each of the aforementioned venting structures 140, 200 may be incorporated into an ink tank lid or other structure for venting a single ink reservoir. The aforementioned exemplary embodiments have been shown for multiple reservoirs, however, those skilled in the art will understand that these structures may be selectively located and utilized in only one ink reservoir, depending upon obvious design considerations. Those skilled in the art reviewing the exemplary discussion and representative drawings will certainly be familiar with techniques to implement this invention in a single ink reservoir and therefore, for purposes of brevity, further discussion has been omitted.

Following from the above description and invention summaries, it should be apparent to those of ordinary skill in the art that, while the methods and apparatuses herein described constitute exemplary embodiments of the present invention, the invention contained herein is not limited to this precise embodiment and that changes may be made to such embodiments without departing from the scope of the invention as defined by the claims. Additionally, it is to be understood that the invention is defined by the claims and it is not intended that any limitations or elements describing the exemplary embodiments set forth herein are to be incorporated into the interpretation of any claim element unless such limitation or element is explicitly stated. Likewise, it is to be understood that it is not necessary to meet any or all of the identified advantages or objects of the invention disclosed herein in order to fall within the scope of any claims, since the invention is defined by the claims and since inherent and/or unforeseen advantages of the present invention may exist even though they may not have been explicitly discussed herein.

What is claimed is:

1. An inkjet cartridge comprising an ink container including a venting structure, comprising: an orifice extending from a top to a bottom surface of a tank lid of the ink container in direct communication with a meniscus baffle extending into an interior of the ink container, the meniscus baffle further having a convex top extending into the tank lid above the bottom surface and below the top surface of the tank lid and attaching to the tank lid with a plurality of bridges spaced apart around the convex top to define a plurality of holes at the bottom surface of the tank lid in fluid communication with said orifice.

2. The inkjet cartridge of claim 1, wherein at least one of the plurality of the holes transitions into an open trough vertically within the interior of the ink tank.

3. The inkjet cartridge of claim 2, wherein:

the open trough is at least partially defined by a vertically inclined projection and at least two ledges longitudinally extending along the projection; and at least one of the two ledges includes a non-circular cross-section.

4. The inkjet cartridge of claim 3, wherein at least one of the two ledges includes a cross-section area substantially a frustum of a pyramid, where the cross-section area of the frustum decreases along a longitudinal portion of the projection.

5. The inkjet cartridge of claim 1, wherein the convex top includes at least one of a conical shape and a domed shape.

6. The inkjet cartridge of claim 1, further comprising a printhead in a fluid communication with the interior of the ink container.

7. The inkjet cartridge of claim 1, wherein each of the plurality of holes has a cross-sectional area less than ten percent of a cross-sectional area of the orifice.

8. An inkjet cartridge lid comprising a lid structure including an external surface defined in part by a serpentine trench that intersects with an conduit extending through the lid structure, the lid structure also comprising a venting structure including a recessed watershed cooperating with an interior wall of the conduit to demarcate a plurality of orifices, a least one of the plurality of orifices in series with a vertically angled gutter of the watershed to establish fluid communication between the gutter and an opening of the conduit at the external surface of the lid structure, wherein the gutter is at least partially defined by a vertically inclined projection and at least two ridges longitudinally extending along the projection; and at least one of the two ridges includes a V-shaped cross-section area substantially a frustum of a pyramid, where the cross-section area of the frustum decreases along a longitudinal portion of the trough.

9. The inkjet cartridge lid of claim 8, wherein the vertically angled gutter includes a non-circular cross-section.

10. The inkjet cartridge of claim 9, further comprising a printhead in fluid communication with the interior of the ink container.

11. The inkjet cartridge of claim 8, wherein the watershed includes at least one of the conical shape and domed shape.

* * * * *